United States Patent [19]

Dietz et al.

[11] Patent Number: 4,817,322

[45] Date of Patent: Apr. 4, 1989

[54] BARREL PROTECTOR FOR A WEAPON

[75] Inventors: Raymond Dietz, Elko; Mark E. Morris, Chaska, both of Minn.

[73] Assignee: Quality Mold, Inc., Eden Prairie, Minn.

[21] Appl. No.: 94,414

[22] Filed: Sep. 9, 1987

[51] Int. Cl.[4] ..... F41C 21/14

[52] U.S. Cl. ..... 42/96

[58] Field of Search ..... 42/96

[56] References Cited

U.S. PATENT DOCUMENTS

| | | | |
|---|---|---|---|
| 2,385,051 | 9/1945 | Berlin et al. | 42/96 |
| 2,545,473 | 3/1951 | Kremkau | 42/96 |
| 3,063,184 | 11/1962 | Sukala, Jr. | 42/96 |
| 3,354,569 | 11/1967 | Kassabian | 42/96 |
| 3,455,047 | 7/1969 | Hoag | 42/96 |

FOREIGN PATENT DOCUMENTS

| | | | |
|---|---|---|---|
| 22756 | 1/1981 | European Pat. Off. | 42/965 |
| 1157966 | 11/1963 | Fed. Rep. of Germany | 42/96 |
| 361315 | 6/1906 | France | 42/96 |
| 12087 | 6/1916 | United Kingdom | 42/96 |

*Primary Examiner*—Stephen C. Bentley
*Assistant Examiner*—Michael J. Carone
*Attorney, Agent, or Firm*—Hugh D. Jaeger

[57] ABSTRACT

A barrel protector which is positioned on the end of a weapon for maintaining the barrel free of water and dust. The barrel protector can fit over the end of a muzzle loader, shot gun, rifle, hand gun, or a military weapon. The barrel protector is plastic, or like material, which includes substantially continuous side rims for surrounding the end of a barrel, a covering member over the rim, a central portion of the covering member being thin. The thin central portion breaks away when the weapon is fired.

6 Claims, 3 Drawing Sheets

BARREL PROTECTOR FOR A WEAPON

BACKGROUND OF THE INVENTION

1. Field of the Invention

The present invention pertains to a barrel protector, and more importantly, pertains to a barrel protector for any type of weapon with a barrel of any configuration. The barrel protector can be used by sportsman, law enforcement personnel, and the military.

2. Description of the Prior Art

Previous structures have been utilized to protect barrels of guns from the weather. Thin rubber caps have been utilized. Plugs have also been utilized. Sometimes these caps and plugs had to be removed which caused delays in firing the weapon.

U.S. Pat. No. 2,545,473 discloses muzzle cover. U.S. Pat. No. 3,063,184 also discloses a muzzle cover. U.S. Pat. No. 3,354,569 discloses a sheath. U.S. Pat. No. 3,593,451 discloses a plug. U.S. Pat. No. 4,084,340 also discloses a plug.

The present invention overcomes the disadvantages of the prior art by providing a barrel protector for the end of a weapon which is lightweight, and protects the interior of the barrel, while also allowing for the discharge of the fire arm.

SUMMARY OF THE INVENTION

The general purpose of the present invention is to provide a barrel protector for a weapon, such as a muzzle loader, shot gun, hand gun, or military weapon, which is a lightweight and inexpensive structure and which provides for discharge of the weapon. More importantly, the use of the barrel protector provides no risk of usage to the individual.

According to one embodiment of the present invention, there is provided a barrel protector for a weapon, including a substantially continuous or noncontinuous side rim as illustrated for surrounding the end of a barrel of a weapon. The rim includes a member of a finite height for encompassing about an end portion of the barrel, a covering member about the rim, and a very thin central portion in said covering member, where the very thin central portion breaks away on discharge of the weapon, providing for departure of the projectile from the barrel of the weapon.

One significant aspect and feature of the present invention includes keeping the barrel from being contaminated.

Another significant aspect and feature of the present invention indicates to an individual if a stick or foreign object has entered the barrel of the weapon in that the protector would be displaced.

Having thus described the embodiments of the present invention, it is the principal object hereof to provide a barrel protector for a weapon.

One object of the present invention includes a low cost and lightweight plastic covering for the barrel of a weapon.

Another object of the present invention is to provide a barrel protector for any type of weapon including a muzzle loader, shot gun, rifle, hand gun, musket or military weapon.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the FIGURES thereof and wherein.

DESCRIPTION OF THE PREFERRED EMBODIMENTS

Figure 1:
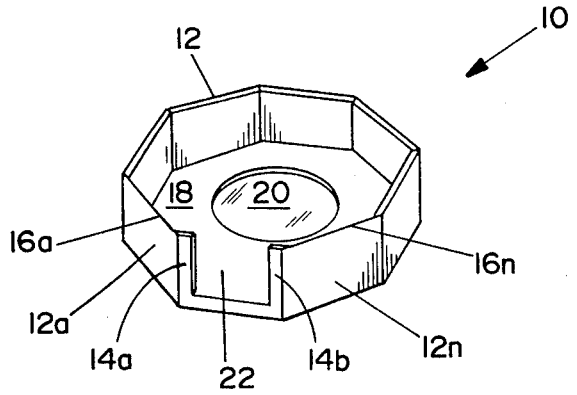
FIG. 1 illustrates a bottom perspective view of a barrel protector, the present invention.

FIG. 1 illustrates a bottom perspective view of a barrel protector 10, the present invention, including side rims **12*a*–12*n*, lips 14*a* and 14*b*, beveled edges 16*a*–16*n*, a covering member 18, and a thin central portion 20. A space 22 between the lips 14*a* and 14*b* provides for a degree of flexibility over the barrel of the weapon. The barrel protector 10** can be made from any suitable material, such as polymers, including polystyrene, polyethylene, etc.

Figure 7:
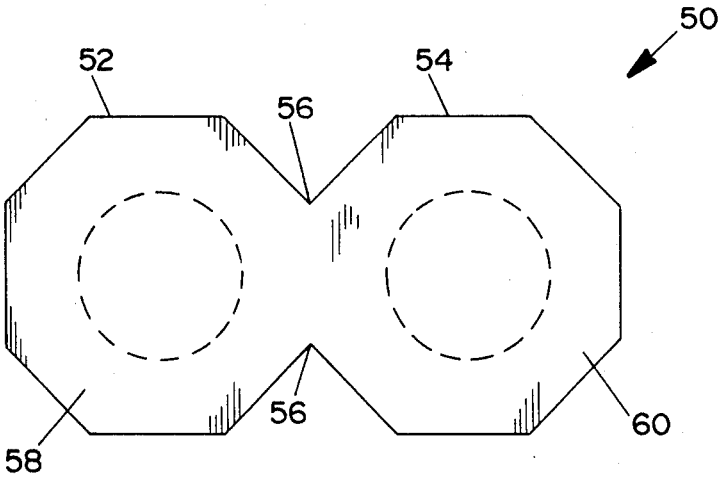
FIG. 7 illustrates an alternative embodiment of a barrel protector for a double barrel weapon.

In this particular embodiment, and by way of example and for purposes of illustration only and not to be construed as limiting of the present invention, the barrel protector 10 is octagonal in shape, but can also assume a round geometrical shape, and for double barrel weapons can include a dual member configuration as illustrated in FIG. 7. The thickness of the thin central portion 20 is in the range of 0.006″–0.008″. The width of the thin central portion 20 is dependent upon the width or thickness of the barrel. The depth of side rims **12*a*–12*n* is dependent upon the diameter of the barrel, the bore of the gun, and the amount of depth needed to maintain tee barrel protector 10** in place and in firm frictional engagement.

Figure 2:
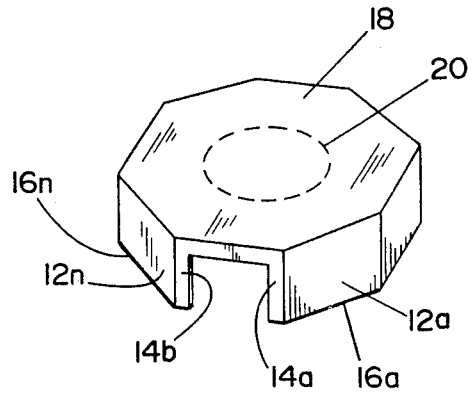
FIG. 2 illustrates a top perspective view of a barrel protector.

FIG. 2 illustrates a top perspective view of the barrel protector 10 of FIG. 1 where all numerals correspond to those elements previously described.

Figure 3:
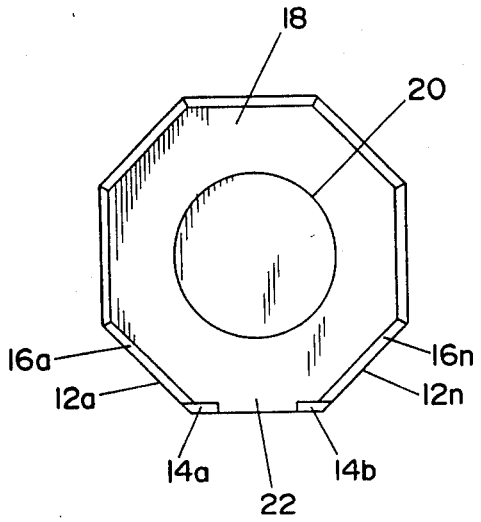
FIG. 3 illustrates a bottom view of a barrel protector.

FIG. 3 illustrates a bottom view of the barrel protector 10 where all numerals correspond to those elements previously described.

Figure 4:
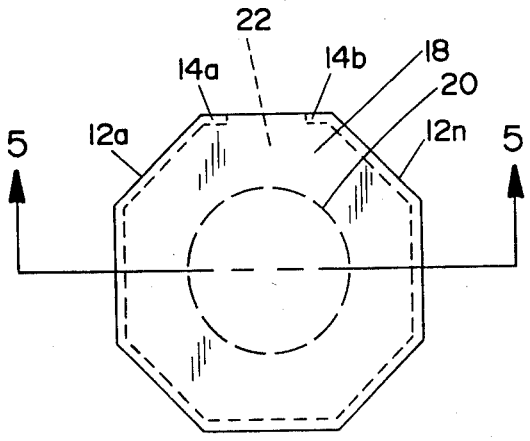
FIG. 4 illustrates a top view of a barrel protector.

FIG. 4 illustrates a top view of the barrel protector 10 where all numerals correspond to those elements previously described.

Figure 5:
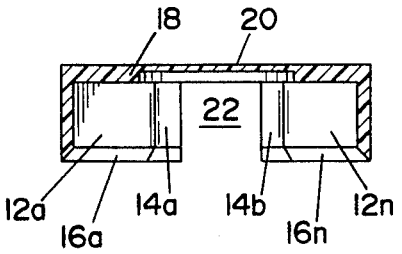
FIG. 5 illustrates a view taken along line 5—5 of FIG. 4.

FIG. 5 illustrates a view taken along line 5—5 of FIG. 4 where all numerals correspond to those elements previously described.

MODE OF OPERATION

Figure 6:
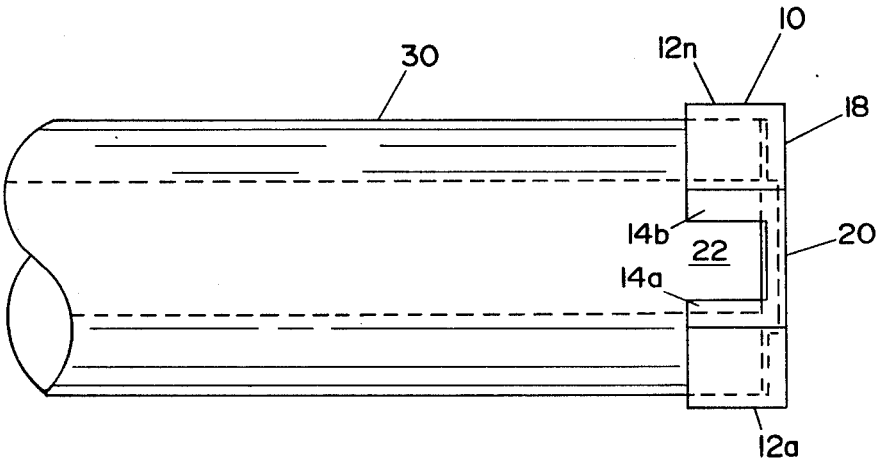
FIG. 6 illustrates the barrel protector in use over a barrel.

FIG. 6 illustrates a side view of a barrel protector 10 around a barrel 30 of a weapon. In operation, the projectile breaks away the thin central portion 20.

ALTERNATIVE EMBODIMENTS

FIG. 7 illustrates a top view of a barrel protector 50 for weapons with dual bores. The barrel protector 50 includes a left section 52, a right section 54, and a common joint 56. The covering members 58 and 60 are continuous through the common joint 56.

The configuration of FIG. 7 can be circular in nature, such as for double barrel shot guns, or take any other geometrical configuration as may be so desired with regard to the shape of the barrels of the weapon. The geometrical shape of FIGS. 1–6 or FIG. 7 are not to be construed as limiting of the present invention.

Various modifications can be made to the present invention without departing from the apparent scope thereof.

I claim:

1. A barrel protector having a bore for at least one barrel of a firearm comprising:

a. side rim means for surrounding an end of a barrel of said firearm b. said side rim means including an inwardly extending thick continuous covering member of a flat surface in a center of said rim means for encompassing and abutting up against an end portion of said barrel; and, c. a substantially thin central member portion of said continuous covering member of a thickness of a range of 0.006–0.008 inches, said thin central member portion, said thick continuous covering, and said barrel protection all of the same polymer material whereby said thin central member portion breaks away when a projectile of said firearm is fired.

2. Barrel protector of claim 1 wherein said firearm is a rifle.

3. Barrel protector of claim 1 wherein said firearm is a shotgun.

4. Barrel protector of claim wherein said firearm is a hand gun.

5. Barrel protector of claim wherein said firearm is a musket.

6. Barrel protector of claim 1 wherein said firearm is a military firearm.

* * * * *